US011548303B2

(12) United States Patent
Berg et al.

(10) Patent No.: US 11,548,303 B2
(45) Date of Patent: Jan. 10, 2023

(54) CONVECTIVE GAS BARS

(71) Applicant: Hewlett-Packard Development Company, L.P., Spring, TX (US)

(72) Inventors: Mark H. Berg, Corvallis, OR (US); Jason Hower, Corvallis, OR (US); Jayanta Panditaratne, San Diego, CA (US); Ronald R. Anderson, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/261,042

(22) PCT Filed: Nov. 13, 2018

(86) PCT No.: PCT/US2018/060758
§ 371 (c)(1),
(2) Date: Jan. 18, 2021

(87) PCT Pub. No.: WO2020/101655
PCT Pub. Date: May 22, 2020

(65) Prior Publication Data

US 2021/0300071 A1 Sep. 30, 2021

(51) Int. Cl.
*B41J 29/02* (2006.01)
*B41J 11/00* (2006.01)

(52) U.S. Cl.
CPC ..... *B41J 29/02* (2013.01); *B41J 11/0022* (2021.01)

(58) Field of Classification Search
CPC .... B41J 29/02; B41J 11/0022; B41F 23/0423; B41F 23/0463; F26B 3/04; F26B 13/00; F26B 13/108
See application file for complete search history.

(56) References Cited

U.S. PATENT DOCUMENTS

| | | | | |
|---|---|---|---|---|
| 3,176,412 | A | 4/1965 | Gardner | |
| 4,767,042 | A | 8/1988 | Daane | |
| 5,181,329 | A | 1/1993 | Devaney et al. | |
| 5,749,164 | A | 5/1998 | Bowden | |
| 6,256,903 | B1 | 7/2001 | Rudd | |
| 6,305,796 | B1 | 10/2001 | Szlucha et al. | |
| 6,463,674 | B1 | 10/2002 | Meyers et al. | |
| 6,564,473 | B2 | 5/2003 | Aydore | |
| 6,581,928 | B1 * | 6/2003 | Stephan | B41F 21/00 271/171 |
| 7,424,781 | B2 | 9/2008 | Fellingham et al. | |
| 2005/0217523 | A1 * | 10/2005 | Hachmann | B41F 23/0443 101/424.1 |

(Continued)

FOREIGN PATENT DOCUMENTS

| | | |
|---|---|---|
| EP | 2361186 B1 | 10/2013 |
| EP | 2960059 | 12/2015 |

(Continued)

*Primary Examiner* — Bradley W Thies

(57) ABSTRACT

In some examples, a convective gas bar can include a gas inlet to receive supply gas to a first portion of the convective gas bar, feed holes located in the first portion, a nozzle plate located in a second portion of the convective gas bar, where the nozzle plate includes nozzles, and the nozzles are adapted to receive and direct the supply gas from the feed holes through the nozzles.

14 Claims, 7 Drawing Sheets

(56) References Cited

U.S. PATENT DOCUMENTS

| | | | | |
|---|---|---|---|---|
| 2008/0084465 | A1* | 4/2008 | Telken ..... | B41F 23/0426<br>347/102 |
| 2012/0060388 | A1 | 3/2012 | Rocheleau et al. | |
| 2014/0210919 | A1 | 7/2014 | Walker et al. | |
| 2015/0089831 | A1 | 4/2015 | Jang et al. | |

FOREIGN PATENT DOCUMENTS

| | | | |
|---|---|---|---|
| EP | 3363635 | A1 | 8/2018 |
| JP | 63-311079 | A | 12/1988 |
| JP | 2001-158079 | A | 6/2001 |
| JP | 2005-030657 | A | 2/2005 |
| JP | 2005-289059 | A | 10/2005 |
| JP | 2015-068637 | A | 4/2015 |
| WO | 2015/130275 | A1 | 9/2015 |

* cited by examiner

CONVECTIVE GAS BARS

BACKGROUND

Imaging systems, such as printers, may be used to form markings on a physical print medium, such as text, images, etc. In some examples, imaging systems may form markings on the print medium by performing a print job. A print job can include forming markings such as text and/or images by transferring print material to the print medium.

DETAILED DESCRIPTION

Imaging devices may form markings on a print medium by applying print material to the print medium. The print material can be applied (e.g., deposited) onto the print medium as the print medium passes through the imaging device during a print job. As used herein, the term "imaging device" refers to any hardware device with functionalities to physically produce representation(s) on the medium.

In examples, a "print medium" may include paper, plastics, composite, metal, wood, or the like. As used herein, the term "print job" may, for example, refer to an application of ink, toner, and/or other material to a physical print medium by an imaging device to process and output the physical print medium. For example, an imaging device may process and output a physical medium including physical representations, such as text, images, models, etc.

An imaging device may apply certain print materials which may include water-based print material. For example, an imaging device can apply an aqueous ink to the print medium during a print job.

Application of an aqueous ink to a print medium during a print job can, in some examples, allow for large print jobs to be performed at a quick rate. However, application of an aqueous ink to a print medium may cause the applied print material to run or otherwise be spoiled without drying the print material as the print medium moves through the imaging device during the print job. Accordingly, various methods of drying may be applied to the print medium.

In some examples, an infrared (IR) dryer may be used to help dry the print material by applying infrared heat to the print medium. In some examples, a high-flow dryer such as an air-knife may be used to blow air on the print medium to help dry the print material. In some examples, a combination IR dryer and air-knife may be utilized.

However, application of energy, such as infrared heat by an IR dryer, may have energy costs. Additionally, air-knives may be expensive to manufacture and can add cost to the imaging device. Further, utilizing air-knives on a print medium without supporting the print medium may cause the print medium to touch a support device which can ruin the print job.

Convective gas bars according to the disclosure can allow for application of gas to a print medium to help remove water from applied print material on a print medium. Convective gas bars can utilize a lower gas flow than air-knives as well as have a lower energy cost than IR dryers. As a result, convective gas bars can allow for drying of print material at a lower capital cost.

Figure 1:
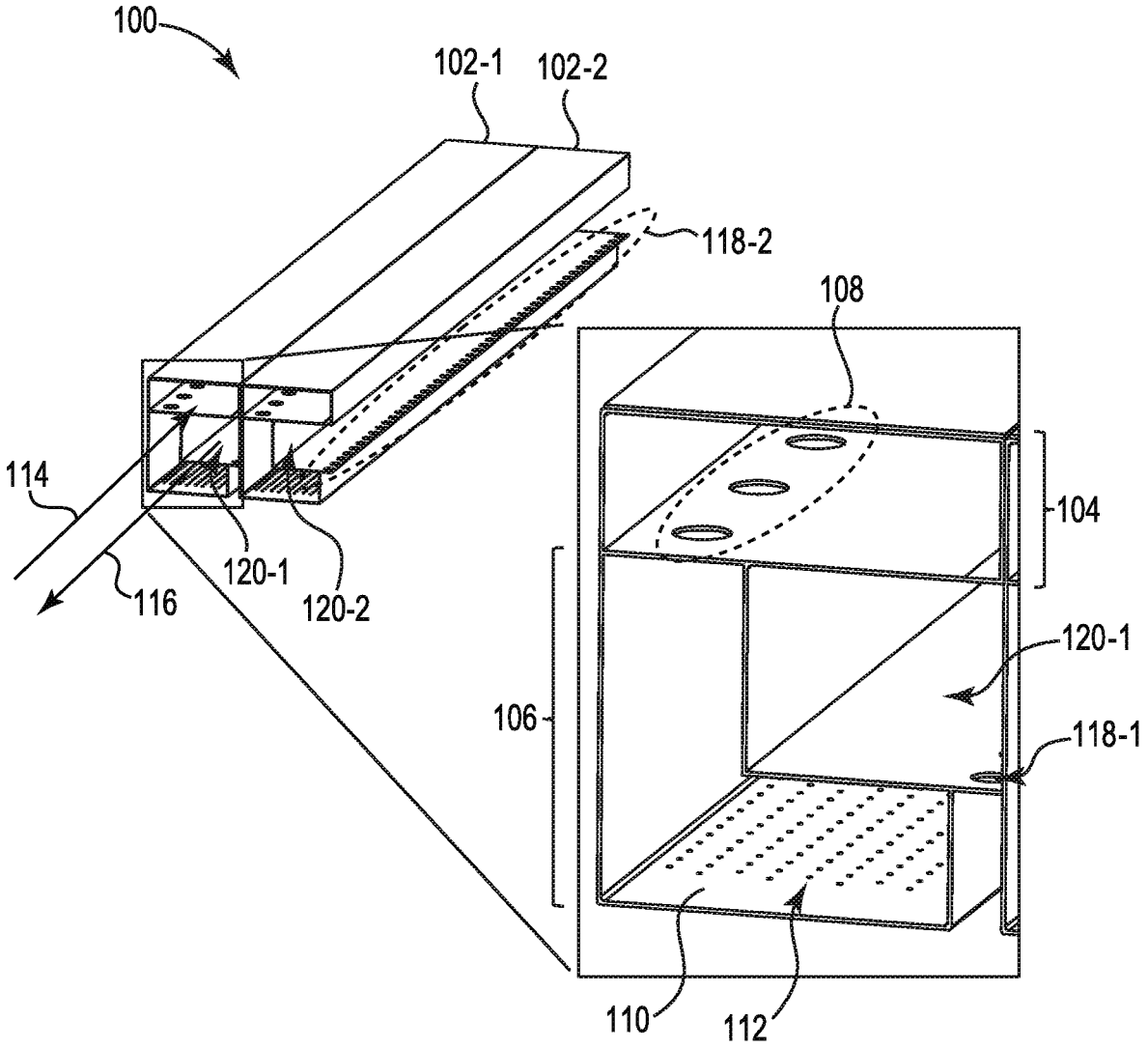
FIG. 1 illustrates a perspective view of an example of a system including convective gas bars consistent with the disclosure.

FIG. 1 illustrates a perspective view of an example of a system 100 including convective gas bars 102 consistent with the disclosure. Convective gas bars 102 can include a supply gas 114, exhaust channel 120, and exhaust gas 116.

As illustrated in FIG. 1, system 100 can include two convective gas bars 102-1, 102-2. As used herein, the term "gas" refers to a substance (e.g., a fluid or combination of fluids) having molecular mobility and expansion properties. Convective gas bars 102-1 and 102-2 can direct convective gas towards a print medium located in a target area, as is further described in connection with FIG. 4. Although illustrated in FIG. 1 as including two convective gas bars 102-1 and 102-2, examples of the disclosure are not so limited. For example, system 100 can include less than two convective gas bars (e.g., one convective gas bar) or more than two convective gas bars. An amount of convective gas bars included in an imaging device can be based on a type of imaging device, a type of print medium, a type of print material, etc.

As illustrated in FIG. 1, system 100 includes a convective gas bars 102-1 and 102-2. For ease of description, examples described herein are described with respect to convective gas bar 102-1. However, examples of the disclosure are not so limited. For example, examples described herein may apply to convective gas bar 102-2, or any other convective gas bar included in a system of convective gas bars.

As used herein, the term "convective gas bar" refers to a device to provide a convective gas flow to a target location. As used herein, the term "convective" refers to a mass transfer of a gas. For example, convective gas bar 102-1 can provide a mass transfer of gas to a target location, as is further described in connection with FIG. 4. In some examples, the gas can be air. However, examples of the disclosure are not so limited. For example, the gas can be any other gas.

Convective gas bar 102-1 can include a gas inlet. As used herein, the term "gas inlet" refers to an entranceway for a supply gas to a convective gas bar. The gas inlet can receive supply gas 114. For example, although not illustrated in FIG. 1 for clarity and so as not to obscure examples of the disclosure, convective gas bar 102-1 can be connected to ductwork via the gas inlet to provide supply gas 114 to convective gas bar 102-1.

As illustrated in the zoomed-in portion of FIG. 1, convective gas bar 102-1 can include a first portion 104 of the convective gas bar 102-1. First portion 104 of convective gas bar 102-1 can include feed holes 108. As used herein, the term "feed hole" refers to an aperture through which supply gas can be fed.

As illustrated in FIG. 1, convective gas bar 102-1 can include multiple feed holes 108. The feed holes 108 can be included down a length (e.g., into the page as oriented in FIG. 1) of the convective gas bar 102-1. The feed holes 108 down the length of convective gas bar 102-1 can distribute supply gas 114 down the length of convective gas bar 102-1.

Feed holes 108 can prevent an amount of supply gas 114 from being substantially directed into the second portion 106 of convective gas bar 102-1 at one end of convective gas bar 102-1. For example, as supply gas 114 is provided to the first portion 104 of convective gas bar 102-1, feed holes 108 can ensure that the supply gas 114 is propagated down the length of convective gas bar 102-1. In other words, feed holes 108 can prevent a gradient in an amount of supply gas 114 from occurring down the length of convective gas bar 102-1 and can instead help to ensure that a similar amount of supply gas 114 is distributed down the length of convective gas bar 102-1.

As illustrated in the zoomed-in portion of FIG. 1, convective gas bar 102-1 can include a second portion 106 of the convective gas bar 102-1. Second portion 106 of convective gas bar 102-1 can include a nozzle plate 110 having nozzles 112. As used herein, the term "nozzle plate" refers to a thin flat sheet of material having a substantially uniform thickness. As used herein, the term "nozzle" refers to a device to control direction and/or characteristics of a fluid flow. For example, nozzles 112 can be included on a nozzle plate and can control characteristics and/or a direction of the supply gas 114 after being directed towards nozzles 112 by feed holes 108. In other words, nozzles 112 are adapted to receive and direct the supply gas 114 from the feed holes 108 through the nozzles 112.

Nozzles 112 can be impingement nozzles. For example, supply air 114 can be directed towards nozzles 112 such that the supply air 114 can be forced through nozzles 112. The supply air 114 forced through nozzles 112 can impinge on a print medium located in a target area, as is further described in connection with FIG. 4.

As illustrated in FIG. 1, nozzles 112 can be oriented in rows. For example, the nozzles 112 can be oriented in a straight-line arrangement down the length of convective gas bar 102-1, as is further described in connection with FIG. 2.

Nozzles 112 can receive and direct supply gas 114 from the feed holes 108. The nozzles 112 can direct the supply gas 114 from the feed holes 108 through nozzles 112. The supply gas 114 can be directed through nozzles 112 to impinge on a print medium located in a target area. The supply gas 114 can impinge on the print medium down a length of the convective gas bar 102-1 (and correspondingly down a length of the print medium) in order to dry print material on the print medium.

As illustrated in FIG. 1, convective gas bar 102-1 can include exhaust ports 118-1. As used herein, the term "exhaust port" refers to an aperture through which exhaust gas can be fed. For example, exhaust ports 118-1 can receive gas after it has impinged on the print medium located in the target area. In other words, gas directed through the nozzles 112 of the nozzle plate 110 can be re-directed through exhaust ports 118-1, where portions of the gas have impinged on the print medium located in the target area.

Second portion 106 of convective gas bar 102-1 can include an exhaust channel 120-1. As used herein, the term "exhaust channel" refers to a passage through which a substance, such as a gas, is transported. For example, exhaust channel 120-1 can receive the gas re-directed through exhaust ports 118-1 from the target area in order to remove the gas from the convective gas bar 102-1 via exhaust channel 120-1.

As previously described above, system 100 can include multiple convective gas bars 102. System 100 can include multiple convective gas bars 102 in order to effectuate drying of print material on a print medium.

Figure 2:
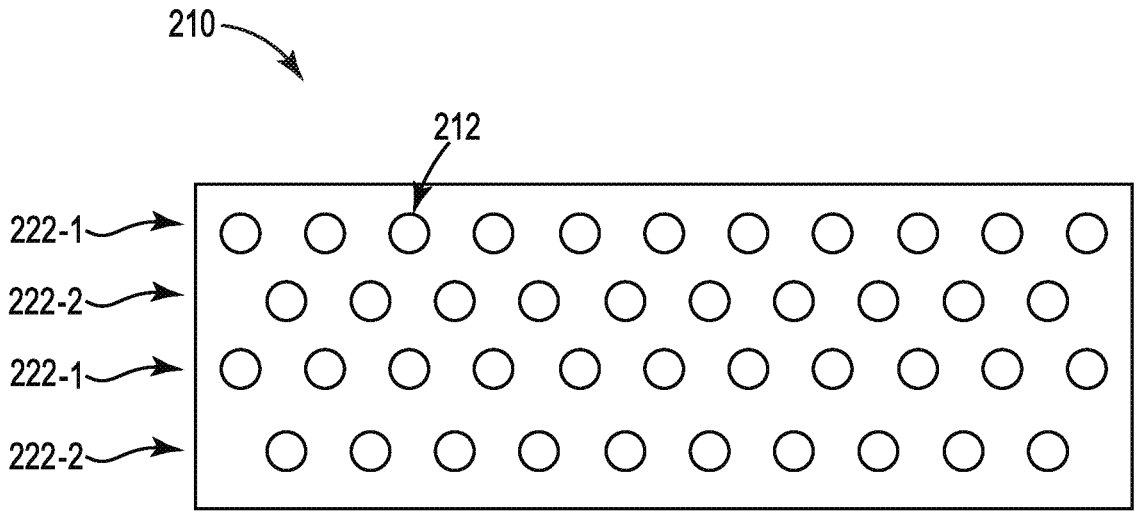
FIG. 2 illustrates a top view of an example of a nozzle plate of a convective gas bar consistent with the disclosure.

FIG. 2 illustrates a top view of an example of a nozzle plate 210 of a convective gas bar consistent with the disclosure. The nozzle plate 210 can include nozzles 212.

As illustrated in FIG. 2, nozzles 212 can be oriented in rows 222. For example, nozzles 212 can be oriented in a straight-line arrangement down a length of the nozzle plate 210 (e.g., left to right as oriented in FIG. 2).

Nozzles included in each row 222 can be uniformly spaced relative to each other. For example, a same distance between each nozzle in a particular row 222 can be present as viewed from left to right in the orientation illustrated in FIG. 2 of nozzle plate 210.

Alternate rows 222-1, 222-2 can be oriented in a non-uniform orientation. For example, the non-uniform orientation of rows 222 can include alternate rows 222-1, 222-2 being staggered relative to each other. For example, nozzles included in the top row 222-1 can be oriented in a straight-line arrangement down the length of nozzle plate 210 and nozzles included in the next row 222-2 can be oriented in a straight-line arrangement down the length of nozzle plate 210. However, the nozzles included in row 222-1 and the nozzles included in row 222-2 can be oriented in a zigzag manner relative to each other.

Figure 3:
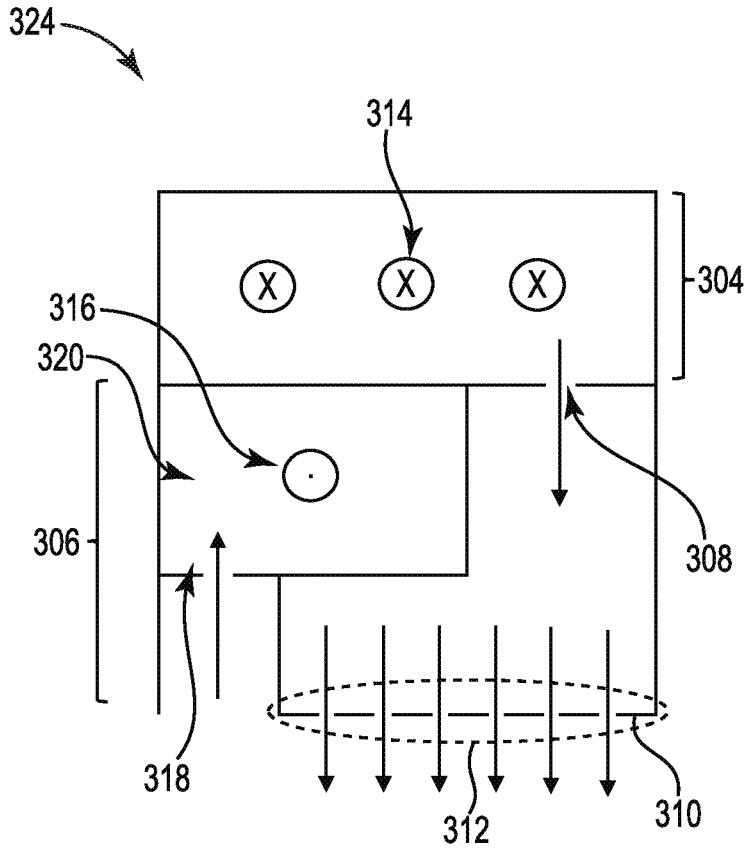
FIG. 3 illustrates a side view of an example of a convective gas bar consistent with the disclosure.

FIG. 3 illustrates a side view of an example of a convective gas bar 324 consistent with the disclosure. The convective gas bar 324 can include a first portion 304 and a second portion 306.

As illustrated in FIG. 3, first portion 304 can receive supply gas 314 at a gas inlet. Supply gas 314 is indicated in FIG. 3 as being received in a direction "into" the page as oriented in FIG. 3 by an X with a circle surrounding the X. The direction "into" the page can correspond to a length of the convective gas bar as oriented and illustrated in FIG. 1.

First portion 304 can include feed holes 308. Feed holes 308 can be included down the length of convective gas bar 324. Feed holes 308 can distribute supply gas 314 to second portion 306. For example, as supply gas 314 is received by first portion 304, feed holes 308 can direct the supply gas 314 towards the nozzles 312 included in nozzle plate 310 as is further described herein.

Second portion 306 can include a nozzle plate 310. The nozzle plate 310 can include nozzles 312. Nozzles 312 can receive supply gas 314 from feed holes 308 and direct the supply gas 314 from feed holes 308 through nozzles 312.

The nozzles 312 can direct the supply gas 314 towards a target area. The target area can be "below" the convective gas bar 324 as oriented in FIG. 3. The target area can include a print medium. The supply gas 314 can be directed by the nozzles 312 towards the print medium located in the target area, as is further described in connection with FIG. 4.

The gas can be received by exhaust ports 318. For example, exhaust ports 318 can be adapted to receive the gas directed through the nozzles 312 of the nozzle plate 310. The gas can be received by exhaust ports 318 after interaction with a print medium. The gas can be directed through exhaust ports 318 into exhaust channel 320.

As illustrated in FIG. 3, convective gas bar 324 can include exhaust channel 320. Following interaction with the print medium, the gas can be exhausted through exhaust channel 320. The gas is indicated in FIG. 3 as being exhausted in a direction "out of" the page as oriented in FIG. 3 by dot with a circle surrounding the dot.

Figure 4:
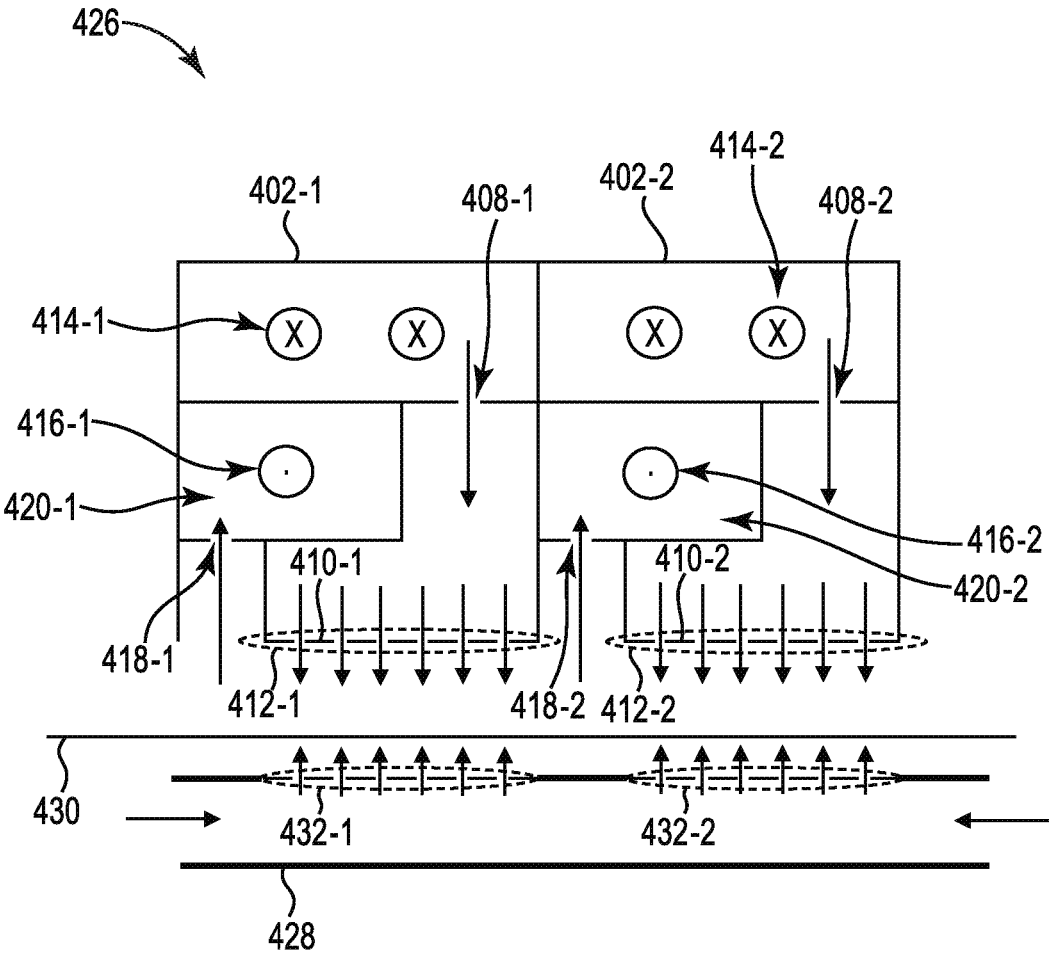
FIG. 4 illustrates a side view of an example system consistent with the disclosure.

FIG. 4 illustrates a side view of an example system 426 consistent with the disclosure. System 426 can include convective gas bars 402-1, 402-2, gas support bar 428, and print medium 430.

As previously described in connection with FIG. 1, system 426 can include convective gas bars 402-1, 402-2. For ease of description, examples described herein are described with respect to convective gas bar 402-1. Although two convective gas bars 402-1, 402-2 are shown in FIG. 4, examples of the disclosure are not so limited. For example, system 426 can include less than two convective gas bars or more than two convective gas bars.

Convective gas bar 402-1 can include a gas inlet. The gas inlet can receive supply gas 414-1. Supply gas 414-1 is indicated in FIG. 4 as being received in a direction "into" the page as oriented in FIG. 4 by an X with a circle surrounding the X. The direction "into" the page can correspond to a length of the convective gas bar as oriented and illustrated in FIG. 4.

Although not illustrated in FIG. 4 for clarity and so as not to obscure examples of the disclosure, in some examples, convective gas bar 402-1 can include a heating element. For example, the heating element can heat supply gas 414-1 as it is received and distributed down the length of convective gas bar 402-1 to feed holes 408-1. In some examples in which heated supply gas 414-1 is warranted but in which convective gas bar 402-1 does not include a heating element, convective gas bar 402-1 can receive pre-heated supply gas 414-1. In some examples, the pre-heated supply gas 414-1 can be combustion products. For instance, the combustion products can be from burning a fuel, such as natural gas, which can pre-heat supply gas 414-1.

Convective gas bar 402-1 can include feed holes 408-1. Feed holes 408-1 can be included down the length of convective gas bar 402-1 and can allow supply gas 414-1 to be distributed down the length of convective gas bar 402-1. Distributing supply gas 414-1 down the length of convective gas bar 402-1 can prevent a gradient of an amount of supply gas 414-1 down the length of convective gas bar 402-1.

Feed holes 408-1 can distribute supply gas 414-1 to nozzle plate 410-1. Nozzle plate 410-1 can include nozzles 412-1. Nozzles 412-1 can direct the supply gas 414-1 from the feed holes 408-1 towards a target area.

The target area can be "below" the convective gas bar 402-1 as oriented in FIG. 4. As illustrated in FIG. 4, the target area can include a print medium 430. For example, following application of print material to the print medium 430 during a print job, the print material may be wet and may have to be dried. Drying of the print material may be desired in order to avoid spoiling the applied print material on the print medium 430 as the print medium 430 moves through the imaging device.

The nozzles 412-1 can direct supply air 414-1 towards the print medium 430. For example, the nozzles 412-1 can direct the supply air 414-1 through nozzle plate 410-1 to impinge on the print medium 430. The nozzles 412-1 can direct the supply air 414-1 at a velocity so as to cause drying of the print material applied to print medium 430. For example, nozzles 412-1 can direct supply air 414-1 towards print medium 430 at a velocity of between 60 to 100 meters per second (m/s), although examples of the disclosure are not so limited to the above described exit velocity of nozzles 412-1.

The gas can be received by exhaust ports 418-1. For example, following interaction with print medium 430, the gas can be directed through exhaust ports 418-1 into exhaust channel 420-1. Following interaction with the print medium, the gas can be exhausted through exhaust channel 420-1. The gas is indicated in FIG. 4 as being exhausted in a direction "out of" the page as oriented in FIG. 4 by dot with a circle surrounding the dot.

As illustrated in FIG. 4, system 426 can include a gas support bar 428. As used herein, the term "gas support bar" refers to a device to provide a convective gas flow to a target location. For example, gas support bar 428 can provide a mass transfer of gas to a target location. In some examples, the gas can be air. However, examples of the disclosure are not so limited. For example, the gas can be any other gas.

Gas support bar 428 can include nozzles 432-1, 432-2. For ease of description, examples described herein are described with respect to nozzles 432-1, but equally apply to nozzles 432-2.

Gas support bar 428 can receive a support gas. The nozzles 432-1 can direct the support gas towards print medium 430. For example, nozzles 432-1 can control a direction of the support gas to direct the support gas towards the target area and print medium 430.

As described above, nozzles 412-1 can direct supply gas 414-1 to a printed side of print medium 430 in order to impinge on print medium 430 to dry print material applied to print medium 430. Support gas 430 can provide a support to print medium 430. The support to print medium 430 can prevent print medium 430 from contacting gas support bar 428 as supply gas 414-1 is impinging on the printed side of print medium 430. That is, gas support bar 428 can direct support gas to a non-printed side of print medium 430 to support print medium 430 while supply gas 414-1 is directed to the printed side of print medium 430 to dry the print material on print medium 430.

A flow rate of support gas of nozzles 432-1 can be proportional to the flow rate of supply gas 414-1 from nozzles 412-1. For example, as described above, nozzles 412-1 can direct supply air 414-1 towards a printed side of print medium 430 at a velocity of between 60 to 100 m/s, whereas nozzles 432-1 can direct support air towards a non-printed side of print medium 430 at a velocity of between 6 to 10 m/s, although examples of the disclosure are not so limited to the above described exit velocity of nozzles 432-1.

Figure 5:
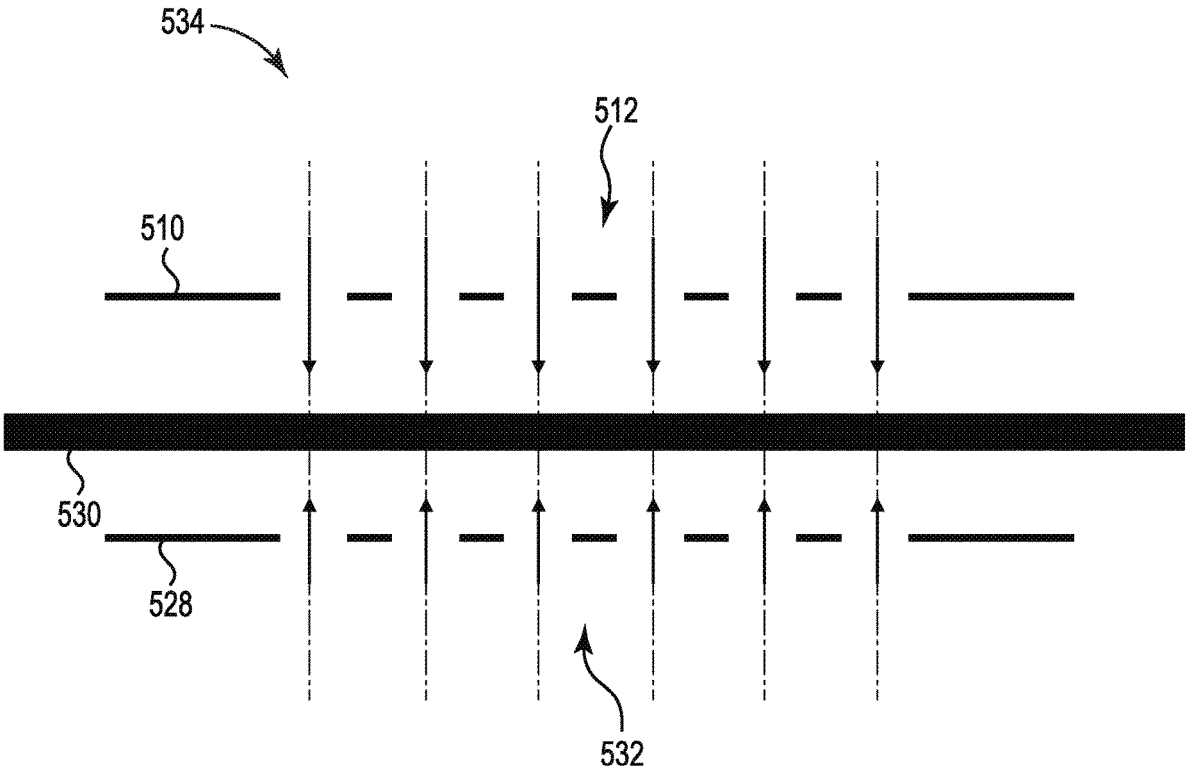
FIG. 5 illustrates a side view of an example nozzle plate and gas support bar consistent with the disclosure.

FIG. 5 illustrates a side view of an example nozzle plate 510 and gas support bar 528 consistent with the disclosure. As illustrated in FIG. 5, nozzle plate 510 can include nozzles 512 and gas support bar 528 can include nozzles 532.

As illustrated in FIG. 5, nozzles 512 and nozzles 532 can be coaxially located. As used herein, the term "coaxial" refers to two geometric shapes having a common axis. For example, the shape of nozzles 512 and the shape of nozzles 532 can share a same axis.

As a result of nozzles 512 and nozzles 532 sharing a common axis, a flow direction of the supply gas through nozzles 512 can be in a direction opposite to that of a flow direction of the support gas through nozzles 532. Orienting the nozzle plate 510 and the gas support bar 528 such that the flow direction of supply gas and the flow direction of the support gas being in directions directly opposing each other can allow for print medium 530 to maintain a substantially straight shape as print medium 530 moves through the imaging device.

Figure 6:
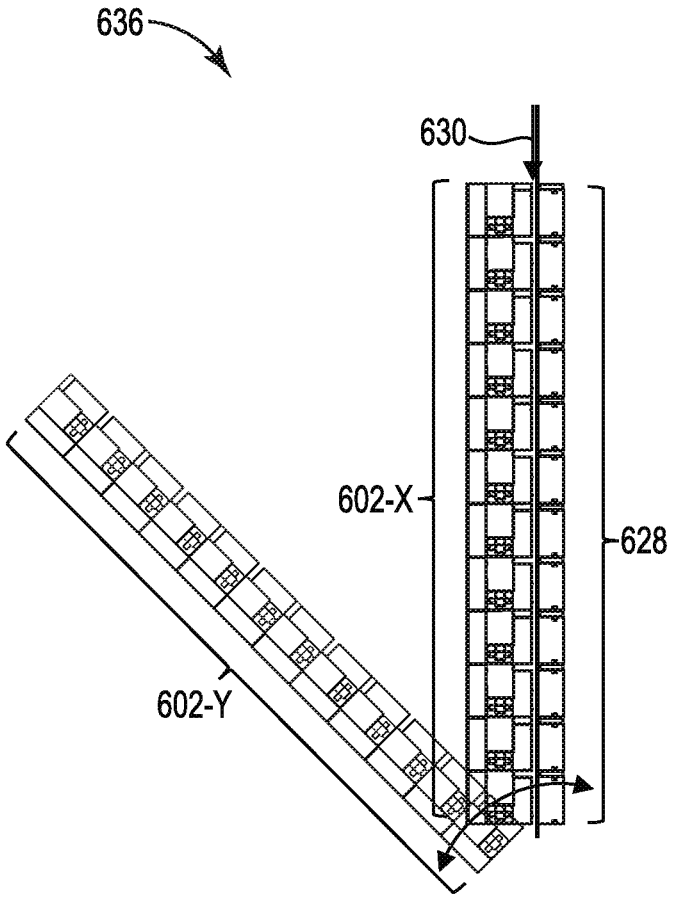
FIG. 6 illustrates a side view of a portion of an example imaging device having single pass print media drying.

FIG. 6 illustrates a side view of a portion of an example imaging device 636 having single pass print media drying. As illustrated in FIG. 6, the portion of the example imaging device 636 can include convective gas bars 602, gas support bars 628, and print media 630.

As illustrated in FIG. 6, the portion of the example imaging device 636 can include single pass print media drying. For example, the print media can pass through the convective gas bars 602 and gas support bars 628 a single time such that the convective gas bars 602 can dry print material applied to the print media 630. As illustrated in FIG. 6, the printed side of print media 630 can be on the left side and the non-printed side of the print media 630 can be on the right side. The print media 630 can move through the portion of the imaging device 636 having the convective gas bars 602 and gas support bars 628 in a downward manner as indicated in FIG. 6.

In some examples, convective gas bars 602 can be removed from the portion of the example imaging device 636. For instance, in the single pass print media drying example illustrated in FIG. 6, the convective gas bars 602 can be rotated away from print media 630 and gas support bars 628 about a rotation axis as indicated in FIG. 6. For example, convective gas bars 602 are illustrated in FIG. 6 as being installed at 602-X and as being removed/rotated at 602-Y. Removal of the convective gas bars 602 can allow for thread-up of print media 630 and/or servicing of the imaging device.

Figure 7:
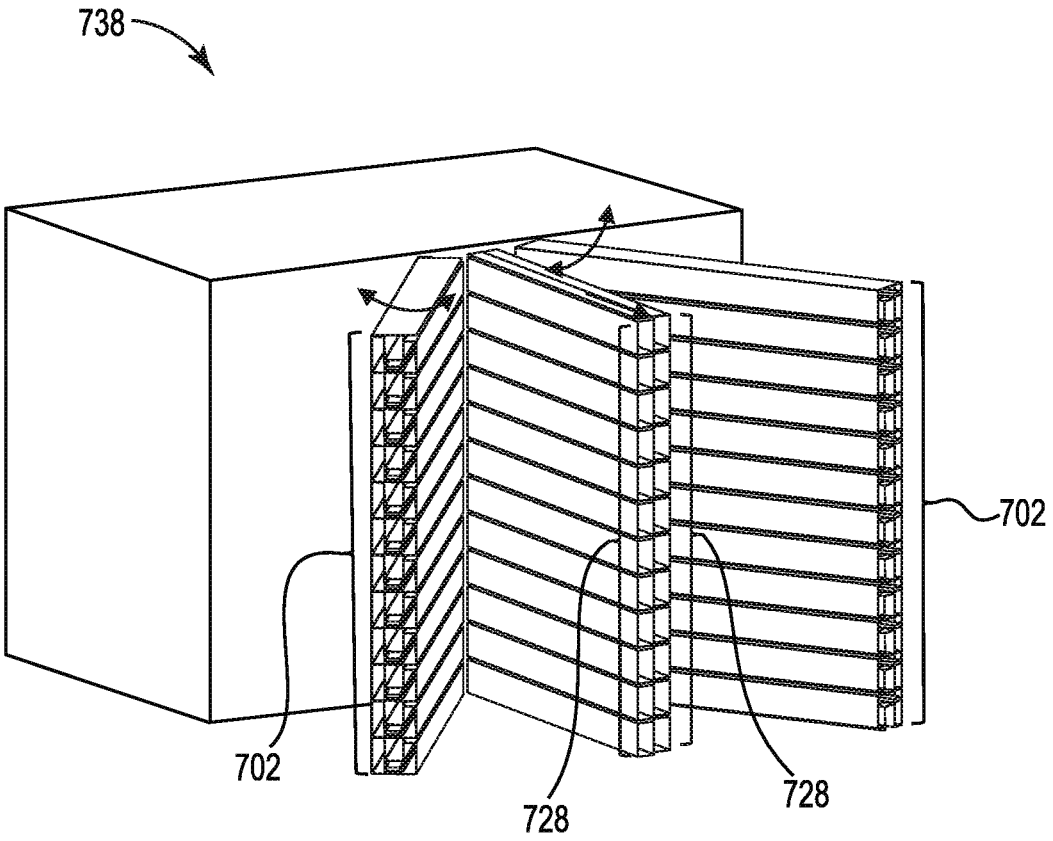
FIG. 7 illustrates a perspective view of a portion of an example imaging device having double pass print media drying.

FIG. 7 illustrates a perspective view of a portion of an example imaging device 738 having double pass print media drying. As illustrated in FIG. 7, the portion of the example imaging device 738 can include convective gas bars 702 and gas support bars 728.

In double pass print media drying, the print media can be passed by two sets of convective gas bars 702. As described above, print material can be applied to a print media on a side of the print media. The side of the print media having the applied print material can be passed by convective gas bars 702 such that the convective gas bars 702 can dry the applied print material on the print media. For example, the print media can be passed by the convective gas bars 702 on the left side of the portion of the example imaging device 738, be routed over the top of gas support bars 728, and be routed down so that the print media can be passed by the convective gas bars 702 on the right side of the portion of the example imaging device 738. The print media can be oriented such that the side of the print media having the applied print material can be facing towards the convective gas bars 702 as the print media moves through the portion of the imaging device 738 so that the convective gas bars 702 can dry the applied print material. Accordingly, the print media can pass by convective gas bars 702 on the left and convective gas bars 702 on the right of the example imaging device 738 (e.g., double pass print media drying).

Although the print media is described above as passing by the left convective gas bars 702 first, being routed over the top of gas support bars 728 and passing by the right convective gas bars 702 second, examples of the disclosure are not so limited. For example, the print media can pass by the right convective gas bars 702 first and/or be routed under the gas support bars 728. Further, the example imaging device 738 can be oriented in any other orientation such that the print media may not always pass by the convective gas bars 702 moving vertically, as described above. For instance, in some examples the example imaging device 738 may be oriented such that the print media can pass by convective gas bars 702 by moving horizontally, or in any other orientation.

In some examples, convective gas bars 702 can be removed from the portion of the example imaging device 738. For instance, in the double pass print media drying example illustrated in FIG. 7, the convective gas bars 702 can be rotated away from gas support bars 728 about a rotation axis as indicated in FIG. 7. Convective gas bars 702 are illustrated in FIG. 7 as being removed/rotated. Further, in some examples, gas support bars 728 can be removed in a linear motion away from the imaging device 738 as indicated in FIG. 7. Removal of the convective gas bars 702 and/or the gas support bars 728 can allow for thread-up of print media and/or servicing of the imaging device.

Although convective gas bars 702 are described as being removable from a double pass print media drying example and convective gas bars 602 are described as being removable from a single pass print media drying example (e.g., as described in connection with FIG. 6), examples of the disclosure are not so limited. For example, convective gas bars and/or gas support bars can be removed from more than double pass print media (e.g., triple pass print media drying, quadruple pass print media drying, etc.)

Convective gas bars, according to the disclosure, can allow lost-cost and energy efficient drying of print material applied to a print medium. A cost of manufacturing, including parts and/or labor costs, can be lower relative to a drying system utilizing IR, air-knives, and/or other drying mechanisms.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 110 may refer to element 110 in FIG. 1 and an analogous element may be identified by reference numeral 210 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. A convective gas bar, comprising:

a first portion defined by a first chamber having a gas inlet to receive supply gas to the first portion of the convective gas bar;

feed holes located through a surface of the first chamber in the first portion to direct the supply gas from the first portion to a second portion;

the second portion defined by an exhaust channel and a second chamber, the exhaust channel located outside of the first chamber, and the second chamber having a nozzle plate located in the second chamber of the convective gas bar, wherein:

the second chamber of the second portion is to receive the supply gas from the first chamber of the first portion via the feed holes;

the nozzle plate includes nozzles;

the nozzles are adapted to receive and direct the supply gas from the feed holes through the nozzles; and the exhaust channel is to receive the supply gas directed through the nozzles of the nozzle plate from the second chamber such that the directed supply gas is removed from the convective gas bar via the exhaust channel.

2. The convective gas bar of claim 1, wherein the convective gas bar further comprises exhaust ports adapted to direct the supply gas directed through the nozzles of the nozzle plate to the exhaust channel.

3. The convective gas bar of claim 1, wherein the nozzles of the nozzle plate are oriented in a plurality of rows.

4. The convective gas bar of claim 3, wherein nozzles included in each row of the plurality of rows are uniformly spaced relative to each other.

5. The convective gas bar of claim 3, wherein alternate rows of the plurality of rows of the nozzle plate are oriented in a non-uniform orientation such that the alternate rows are staggered relative to each other.

6. A convective gas bar, comprising:

a first portion of the convective gas bar defined by a first chamber, including:

a gas inlet to receive supply gas to the first portion of the convective gas bar; and feed holes located through a surface of the first chamber in the first portion to distribute the supply gas from the first portion to a second portion;

the second portion of the convective gas bar defined by an exhaust channel and a second chamber, the exhaust channel located outside of the first chamber, and the second chamber to receive the supply gas from the first chamber of the first portion via the feed holes, wherein:

the second portion includes a nozzle plate including a plurality of nozzles, wherein the plurality of nozzles are adapted to receive and direct the supply gas from the feed holes through the nozzles; and the exhaust channel includes exhaust ports such that the exhaust channel is to receive the gas directed through the nozzles of the nozzle plate from the second chamber such that the directed supply gas is removed from the convective gas bar via the exhaust channel.

7. The convective gas bar of claim 6, wherein the plurality of nozzles are adapted to direct the supply gas from the feed holes through the nozzles towards a print medium.

8. The convective gas bar of claim 6, wherein the gas inlet receives supply gas to the convective gas bar via an edge-feed gas supply.

9. The convective gas bar of claim 6, wherein the exhaust channel exhausts the received gas via an edge-feed gas exhaust.

10. A system, comprising:

a convective gas bar, including:

a first portion defined by a first chamber having a gas inlet to receive supply gas to the first portion of the convective gas bar;

feed holes located through a surface of the first chamber in the first portion to distribute the supply gas from the first portion to a second portion;

the second portion defined by an exhaust channel and a second chamber, the exhaust channel located outside of the first chamber, and the second chamber having a nozzle plate including a first plurality of nozzles to direct the supply gas from the feed holes to a target area wherein:

the second chamber of the second portion is to receive the supply gas from the first chamber of the first portion via the feed holes;

the first plurality of nozzles are adapted to receive and direct the supply gas from the feed holes through the first plurality of nozzles; and the exhaust channel includes exhaust ports, wherein the exhaust channel is to receive the supply gas directed through the first plurality of nozzles via gas ports such that the directed supply gas is removed from the convective gas bar via the exhaust channel; and a gas support bar including a second plurality of nozzles to direct support gas to the target area.

11. The system of claim 10, wherein the target area includes a print medium such that:

the first plurality of nozzles of the convective gas bar directs the supply gas to the print medium; and the second plurality of nozzles of the gas support bar direct the support gas to the print medium.

12. The system of claim 11, wherein the first plurality of nozzles and the second plurality of nozzles are coaxially located such that a flow direction of the supply gas from each nozzle of the first plurality of nozzles is in a direction opposite to that of a flow direction of the support gas from each coaxially located corresponding nozzle of the second plurality of nozzles.

13. The system of claim 10, wherein:

the first plurality of nozzles direct the supply gas to a printed side of a print medium to dry the printed side of the print media; and the second plurality of nozzles direct the support gas to a non-printed side of the print medium to support the print medium, wherein a flow rate of the second plurality of nozzles is proportional to a flow rate of the first plurality of nozzles.

14. The system of claim 10, wherein:

the convective gas bar is of a plurality of convective gas bars of the system; and the plurality of convective gas bars are removable from an imaging device of the system.

* * * * *